US007885809B2

(12) United States Patent
Ramprashad

(10) Patent No.: US 7,885,809 B2
(45) Date of Patent: Feb. 8, 2011

(54) QUANTIZATION OF SPEECH AND AUDIO CODING PARAMETERS USING PARTIAL INFORMATION ON ATYPICAL SUBSEQUENCES

(75) Inventor: Sean A. Ramprashad, Los Altos, CA (US)

(73) Assignee: NTT DoCoMo, Inc., Tokyo (JP)

( * ) Notice: Subject to any disclaimer, the term of this patent is extended or adjusted under 35 U.S.C. 154(b) by 796 days.

(21) Appl. No.: 11/408,125

(22) Filed: Apr. 19, 2006

(65) Prior Publication Data

US 2006/0241940 A1 Oct. 26, 2006

Related U.S. Application Data

(60) Provisional application No. 60/673,409, filed on Apr. 20, 2005.

(51) Int. Cl.
*G10L 19/12* (2006.01)

(52) U.S. Cl. ..... 704/222; 704/229; 704/230; 704/500

(58) Field of Classification Search ..... 704/229, 704/230, 222, 500
See application file for complete search history.

(56) References Cited

U.S. PATENT DOCUMENTS 5,353,375 A * 10/1994 Goto et al. ..... 704/229
5,394,508 A * 2/1995 Lim ..... 704/200.1
5,517,511 A * 5/1996 Hardwick et al. ..... 714/755
5,602,961 A * 2/1997 Kolesnik et al. ..... 704/223
5,680,130 A * 10/1997 Tsutsui et al. ..... 341/87
5,825,976 A * 10/1998 Dorward et al. ..... 704/229
6,704,705 B1 * 3/2004 Kabal et al. ..... 704/230

OTHER PUBLICATIONS

Varshney, L and Goyal, V.K. "Ordered and Disordered Source Coding." Information Theory and Applications Workshop, Feb. 6-10, 2006.*
Varshney, L and Goyal, V.K. "Toward a Source Coding Theory for Sets." Data Compression Conference, Mar. 2005.*
Notification Concerning Transmittal of International Preliminary Report on Patentability (Chapter I of the Patent Cooperation Treaty for PCT Appln No. US2006/015251, mailed Nov. 1, 2007 (17 pages).
PCT International Search Report for PCT Appln No. US2006/015251, mailed Aug. 8, 2006 (4 pages).
PCT Written Opinion for PCT Appln No. US2006/015251, mailed Aug. 8, 2006 (15 pages).

(Continued)

*Primary Examiner*—Talivaldis I Smits
*Assistant Examiner*—Shaun Roberts
(74) *Attorney, Agent, or Firm*—Blakely, Sokoloff, Taylor & Zafman LLP

(57) ABSTRACT

A method and apparatus is disclosed herein for a quantizing parameters using partial information on atypical subsequences. In one embodiment, the method comprises partially classifying a first plurality of subsequences in a target vector into a number of selected groups, creating a refined fidelity criterion for each subsequence of the first plurality of subsequences based on information derived from classification, dividing a target vector into a second plurality of subsequences, and encoding the second plurality of subsequences, including quantizing the second plurality of subsequences given the refined fidelity criterion.

46 Claims, 9 Drawing Sheets

OTHER PUBLICATIONS

Prandom, P. et al.: "Optimal Time Segmentation for Signal Modeling and Compression," Acoustics, Speech, and Signal Processing, 1997. ICASSP-97., 1997 IEEE International Conference on Munich, Germany Apr. 21-24, 1997, Los Alamitos, CA, USA, IEEE Comput. Soc, Us, vol. 3, Apr. 21, 1997, pp. 2029-2032, XP010226332, ISBN: 0-8186-7919-0.
Omar Niamut, Richard Huesdens: "RD Optimal Time Segmentations for the Time-Varying MDCT," Proceedings Eusipco 2004 (European Signal Processing Conference), [Online] Sep. 6, 2004, pp. 1649-1652, XP002391769, Retrieved from the Internet: URL: http://www.eurasip.org/content/Euspico/2004/defevent/papers/crl699.pdf>.
Kuldip K Paliwal et al.: "Efficient Vector Quantization of LPC Parameters at 24 Bits/Frame," IEEE Transactions on Speech and Audio Processing, IEEE Service Center, New Yor, NY, US, vol. 1, No. 1, Jan. 1993, pp. 3-14, XP000358435, ISSN: 1063-6676.
Kleijn, B. et al.: "Speech Coding and Synthesis," chapters 1, 3, 4, 6, 7, 9, 12 & 15, Elsevier, New York, 1995.
Iwakami, N. et al.: "High quality audio-coding at less than 64 kbit/sec by using transform-domain weighted interleave vector quantization ({TWINVQ})." In IEEE Int. Conf. of Acoustics, Speech, Signal Processing, vol. 5, pp. 3095-3098, Detroit, Michigan, May 1995.
Cover, T.M. et al.: "Elements of Information Theory." John Wiley and Sons, pp. 50-59, New York, 1991.
Johnson, J.D. et al.: "Review of {MPEG-4} general audio coding." In A. Puri and T. Chen, editors, "Multimedia Systems, Standards, and Networks," chapter 5. Marcel Dekker, Inc., New York, 2000.
Ramprashad, S.A. et al.: "The Multimode Transform Predictive Coding Paradigm," IEEE Transactions on Speech and Audio Processing, vol. 11, issue 2, pp. 117-129, Mar. 2003.
Chen, J-H.: "A high fidelity speech and audio codec with low delay and low complexity." In IEEE Int. Conf. Acoustics, Speech, Signal Processing, vol. 2, pp. II1 161-II1 164, Istanbul, Turkey, Jun. 2000.
Gersho, A. et al.: Vector Quantization and Signal Compression. Kluwer Academic Publishers, chapter 8 & chapter 16, Boston, 1992.

* cited by examiner

QUANTIZATION OF SPEECH AND AUDIO CODING PARAMETERS USING PARTIAL INFORMATION ON ATYPICAL SUBSEQUENCES

PRIORITY

The present patent application claims priority to and incorporates by reference the corresponding provisional patent application Ser. No. 60/673,409, titled, "A Method for Quantization of Speech and Audio Coding Parameters Using Partial Information on Atypical Subsequences" filed on Apr. 20, 2005.

FIELD OF THE INVENTION

The present invention relates to the field of information coding; more particularly, the present invention relates to quantization of data using information on atypical behavior of subsequences within the sequence of data to be quantized.

BACKGROUND OF THE INVENTION

Speech and audio coders typically encode signals by a combination of statistical redundancy removal and perceptual irrelevancy removal followed by quantization (encoding) of the remaining normalized parameters. With this combination, the majority of advanced speech and audio encoders today operate at rates of less than 1 or 2 bits/input-sample. However, even with advancements in statistical and irrelevancy removal techniques, the bitrates being considered, by definition, often force many normalized parameters to be coded at rates of less than 1 bit/scalar-parameter. At these rates, it is very difficult to increase the performance of quantizers without increasing complexity. It is also very difficult to control or take advantage of the perceptual effects of quantization and/or irrelevancy removal since the granularity of bit-assignments (resource assignments) and the performance of quantizers are limited, in particular when bits are assigned equally among statistically equivalent parameters.

Much of the compression seen in advanced coder design, including design of audio and speech coders, is due to a combination of the early stages of encoding where redundancy and irrelevancy are efficiently encoded and/or targeted for removal from the signal, and the latter stages of encoding which use efficient techniques to quantize the remaining statistically normalized and perceptually relevant parameters.

At low bit rate, the stages of redundancy and irrelevancy removal must be efficient. There are a number of examples of how the stages of redundancy and irrelevancy removal are made efficient. For example, the stages of redundancy and irrelevancy removal may be made efficient using a Linear Predictive Coefficient (LPC) Model of the gross (short-term) shape of the signal spectrum. This model is a highly compact representation that is used in many designs, e.g. in Code Excited Linear Predictive Coders, Sinusoidal Coders, and other coders like the TWIN-VQ and Transform Predictive Coders. The LPC model itself can be efficiently encoded using various state of the art techniques, e.g., vector quantization and predictive quantization of Line Spectral Pair parameters, etc.

Another example of how the stages of redundancy and irrelevancy removal may be made efficient is using compact specifications of the harmonic or pitch structure in the signal. These structures represent redundant structure in the frequency domain or (long-term) redundant structure in the time domain. Common techniques often use a parameter specifying the periodicity of such structures, e.g., the distance between spectral peaks of frequency domain representations or the distance between quasi-stationary time-domain waveforms, using classic parameters such as a pitch delay (time domain) or a "delta-f" (frequency domain).

An additional example of how the stages of redundancy and irrelevancy removal may be made efficient is using gain factors to explicitly encode the approximate value of signal energy in different time and/or frequency domain regions. Various techniques for encoding these gains can be used including scalar or vector quantization of gains or parametric techniques such as the use of the LPC model mentioned above. These gains are often then used to normalize the signal in different areas before further encoding.

Yet another example of how the stages of redundancy and irrelevancy removal may be made efficient is specifying a target noise/quantization level for different time/frequency regions. The levels are calculated by analyzing the spectral and time characteristics of the input signal. The level can be specified by many techniques including explicitly through a bit-allocation or a noise-level parameter (such as a quantization step size) known at the encoder and at the decoder or implicitly through the variable-length quantization of parameters in the encoder. The targets levels themselves are often perceptually relevant and form the basis for some of the irrelevancy removal. Often these levels are specified in a gross manner with a single target level applying to a given region (group of parameters) in time or frequency Once these techniques have reached to limit of their capabilities, e.g. in the extreme case where they have completely normalized the signal statistics and created a bit-allocation or noise-level parameter allocation on these normalized parameters, the techniques can no longer be used to further improve the efficiency of encoding.

It should be noted that even with the best of the forementioned redundancy and irrelevancy techniques the normalized parameters may have variations within them. The presence of variations in subsequences of parameters is well known in some engineering fields. In particular, at higher parameter dimensions, the variations have been noted in fields such as Information Theory. Information Theory notes that subsequences of statistically identical scalars (random variables) can be divided into two groups: one group in which the subsequences conform to a "typical" behavior based on a relevant measure, and another "atypical" group in which the sequences deviate from that "typical" behavior based on the same measure. A precise and complete division of sequences into these two groups is required for the purposes of theoretical analyses in Information Theory.

However, one observation used by Information Theory is that the probability of encountering these latter "atypical" sequences becomes negligible as the subsequences themselves increase in length, i.e. dimension. The result is that the "atypical" subsequences (and their effect and precise handling) are discarded in asymptotic theoretical analyses of Information Theory. In fact, the theoretical analyses use a very inefficient handling of these "atypical" subsequences, the inefficiency of which is irrelevant asymptotically. At lower dimensions, the main issue is whether or not these variations are significant enough to merit more careful handling, or whether they can or should also be ignored.

Local variations in signal statistics have been implicitly (indirectly) handled previously using higher dimensional vector quantizers, e.g. a quantizer with dimension that can be as large as the entire length of the sequences being considered. Therefore while the codewords in a high-dimensional quantizer may, or may not, reflect some of the local average variations within the sequence, there is no explicit consideration of these variations. There are many approaches to using higher dimensional vector quantizers. The most basic is the straight-forward (brute-force) approach of generating a quantizer whose codebook consists of high-dimensional vectors. This is the most complex of the approaches but the one with the best performance in terms of rate-distortion tradeoffs.

There are also other less complex approaches that can also be used to approximate the straight-forward high-dimensional quantizer approach. One approach is to further model the signal (e.g. using an assumed probability marginal density function) and to then do the quantization using a parameterized high-dimensional quantizer. A parameterized quantizer does not necessarily need a stored codebook since it assumes a trivial signal statistic (such as a uniform distribution). An example of a parameterization is a Trellis structure. Such structures also allow for easy searching during encoding. There are also a multitude of other techniques known as structured quantizers.

There are also methods to more directly handle variations within a target vector of interest. There are numerous methods that are used to examine a target vector and produce criteria on how the vector should be encoded. For example, a MPEG type coder takes a vector of MDCT coefficients, analyzes the input signal, and produces fidelity criteria for different groups of MDCT coefficients. Generally, a group of coefficients span a certain support area in time and frequency. Coders like the transform predictive coder and basic transform coders use information of signal energy in a given subband to infer a bit-allocation for that band.

In fact, the creation of criteria is the basis for most speech and audio coding schemes that adapt to the signal. The criteria's creation is the function of earlier stages of the coding algorithm dealing with redundancy removal and irrelevancy removal. These stages produce fidelity criteria for each target sequence "x" of parameters. A single target "x" could represent a single subband or scale-factor band in coders. In general, there are many such "x" in a given frame of speech or audio, each "x" having its own fidelity criteria. These fidelity criteria themselves can be functions of the gross statistical and irrelevancy variations noted by earlier schemes.

Statistical variations within a sequence of normalized vectors can be exploited by using variable-length quantization, e.g. Huffman codes. The codeword assigned to each target vector during quantization is represented by a variable-length code. The code used tends to be longer for codewords that are used less frequently, and shorter for codewords that are used more frequently. Essentially, the situation can be that "typical" codewords are represented more efficiently and "atypical" codewords less efficiently. On average the number of bits used to describe codewords is less than if a fixed-length code (a fixed number of bits) is used to represent codeword indices.

Finally, in recent work, there is discussion about the balance between specifying the only values within a sequence of variables with no information on the order (location) which they occur, and specifying only the order with no information on the values. More recent work, the idea of specifying only "partial information" on the order is also alluded to. The work does show that ignoring either types of information can have benefits, once you can justify that either the order or values of variables is not important. In work on speech and audio coders, both the order and value are important, though it could be that different values have different levels of importance. This is not addressed in the referenced work. For more information, see L. Varshney and V. K. Goyal, "Ordered and Disordered Source Coding", Information Theory and Applications Workshop, Feb. 6-10, 2006 and L. Varshney and V. K. Goyal, "Toward a Source Coding Theory for Sets", Data Compression Conference, March 2005.

SUMMARY OF THE INVENTION

A method and apparatus is disclosed herein for quantizing parameters using partial information on atypical subsequences. In one embodiment, the method comprises partially classifying a first plurality of subsequences in a target vector into a number of selected groups, creating a refined fidelity criterion for each subsequence of the first plurality of subsequences based on information derived from classification, dividing a target vector into a second plurality of subsequences, and encoding the second plurality of subsequences, which includes quantizing the second plurality of subsequences, given the refined fidelity criterion. In another embodiment, the first and second plurality can be the same.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE PRESENT INVENTION

Figure 1:
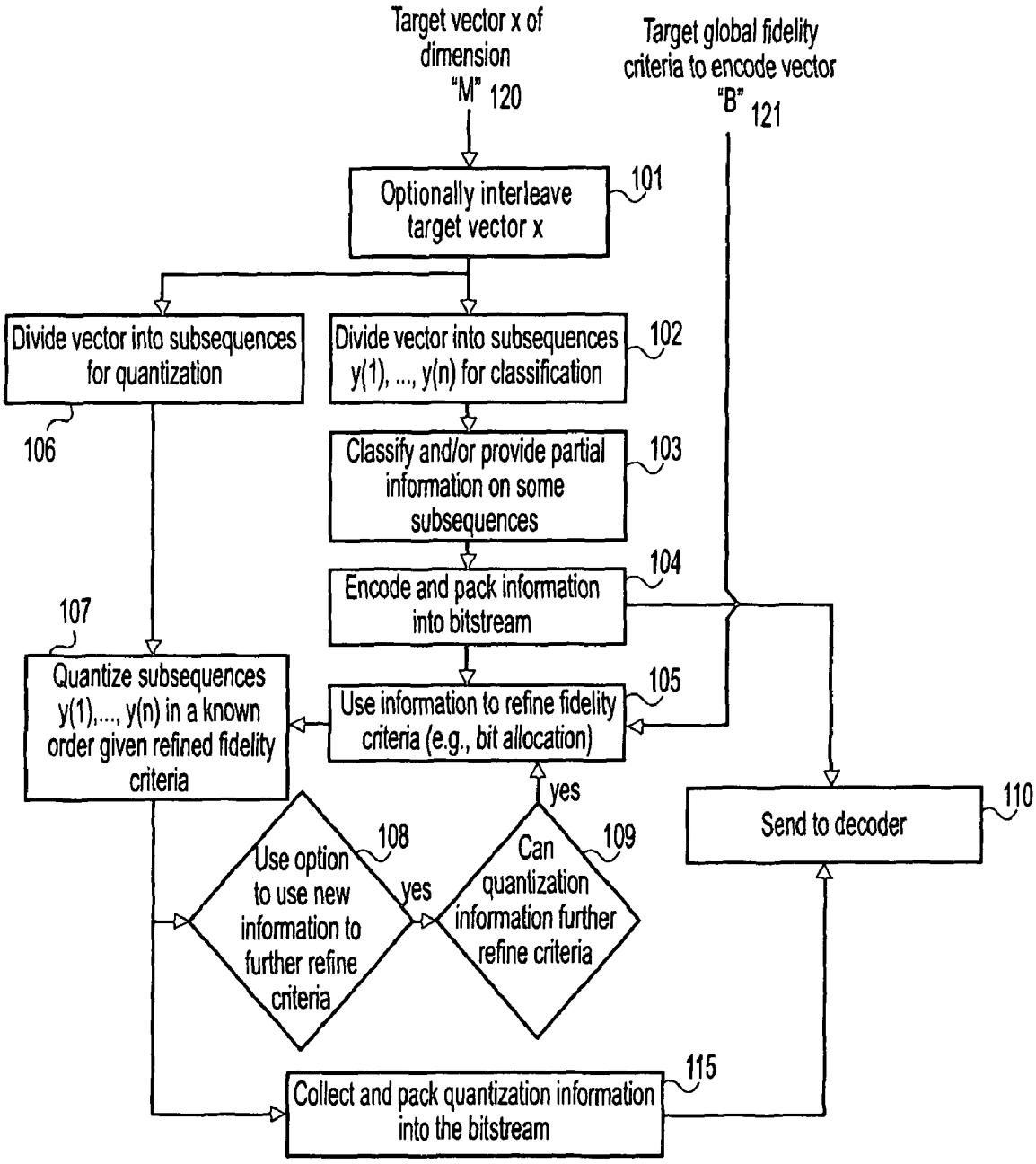
FIG. 1 is a flow diagram of one embodiment of a quantization process.

A technique to improve the performance of quantizing normalized (statistically equivalent) parameters is described. In one embodiment, the quantization is performed under practical constraints of a limited quantizer dimension and operates at low bit rates. The techniques described herein also have the properties that naturally allow it to take advantage of perceptual considerations and irrelevancy removal.

In one embodiment, a sequence of parameters that can no longer benefit from classic statistical redundancy removal techniques is divided into smaller pieces (subsequences). A subset, or a number of subsets, of these subsequences are tagged as containing a statistical variation. This variation is referred to herein as an "atypical" behavior and such tagged sequences are termed "atypical" sequences. That is, from a vector of parameters for which there is no assumed statistical structure, partial (incomplete) information is created about actual (generally random) variations that do exist between subsequences of parameters contained within that vector. The information to be used is partial because it is not a complete specification of the statistical variations. A complete specification would not be efficient as it requires more additional side-information than when only the partial information need be sent. Optionally, the type or types of variations can also be noted (also possibly and often imprecisely) for each subset.

The partial information is used by both the encoder and decoder to modify their handling of the entire sequence of parameters. Thus, the decoder and encoder do not require complete knowledge of which sequences are "atypical", or complete information on the types of variations. To that end, the partial information is encoded into the bitstream and sent to the decoder with a lower overhead than if complete information had been encoded and sent. A number of approaches on how to specify this information and on how to modify coder behavior based on this information are described below.

In one embodiment, the new method takes in a target vector, in this case only one of the types of "x" fore-mentioned in prior art, and further divides this "x" into multiple subsequences, and produces a refined fidelity criteria for each subsequence. In one embodiment, the fidelity criteria are implemented in terms of bit assignments for the subsequences. In one embodiment, bit assignments across the subsequences are created as a function of the partial information. Furthermore, and optionally, these operations include creating purposeful patterns in the bit-assignment to improve perceptual performance given the partial information yet also within the remaining uncertainty not covered by the partial information.

In one embodiment, a procedure encourages the increasing of the number of areas (subsequences) in the vector effectively receiving zero-bit assignments. This embodiment can further take advantage of this approach by using noise-fill to create a usable signal for the areas receiving zero-bit assignments. This joint procedure is effective for very low bit-rates. Furthermore, the noise-fill itself can adapt based on the exact pattern or during the quantization process. For example, the energy of the noise-fill may be adapted. The operations also include quantizing (encoding) and inverse-quantizing (decoding) the entire target using the bit-allocation and noise-fill to produce a coded version of the vector of parameters.

There are a number of differences and advantages associated with the techniques described herein. First, the techniques described herein do no rely on any predictable or structured statistical variation across subsequences. The techniques works even when the components of the sequence come from an independent and identically distributed statistical source. Second, the techniques do not need to provide information for all subsequences, or complete information on any given subsequence. In one embodiment, only partial and possibly imprecise information is provided on the presence and nature of atypical subsequences. This is beneficial as it reduces the amount of information that is transmitted for such information. The fact that the information is partial means that within the uncertainty not specified by the information one can select permutations (quantization options) that have known or potential perceptual advantages. Without any partial information the uncertainty is too great to create or distinguish permutations, and with complete information there is no uncertainty.

In one embodiment, information provided by earlier stages is used. More specifically, by definition, when creating a refined criterion, an original criteria must have existed. Also, it assumes that the signal structure has been normalized. Under these assumptions, the partial information can be effectively used to make the remaining finer distinctions.

In one embodiment, the partial information is simply encoded into a numeric symbol "V". The original criteria "C" and "V" together directly generate a refined criteria. The refined criteria can consist of a pattern of a number of sub-criteria that together conform to "C".

The techniques described herein, when used at low bit rates, have a natural link to the combined use of noise-fill and patterned bit-assignments. The link to noise-fill comes out of the fact that the method can also remove quantization resources (effectively assign zero bits to) from some of the sub-areas of "x". Thus, there is an unequal distribution of resources, and at times, the resources in some areas go to zero. In other words, the values in some areas are not important and therefore, from the point of view of bit-assigned quantization, can be set to zero. Perceptually it is however better to assign a non-zero (often random) value rather than absolutely zero. The patterned bit-assignments will be discussed later but are a result of the freedom within the uncertainty of the information.

In one embodiment, subsequences are arranged in groups, and each group represents a certain classification of a variation of interest. A subsequence's membership in a group implies that the subsequence is more likely to have (not necessarily has) this noted variation. The embodiment allows for a balance between perfect membership information and imprecise membership information. Imprecise membership information simply conveys that a given type of information (classification) is more likely. For example, subsequence "k" may be assigned a membership to group "j", simply because it takes less information than assigning subsequence "k" to another group. One form therefore of the partial information on the variations is the imprecise or partial memberships in the groups.

In another embodiment, one of the groups used signifies that no classification is being conveyed about members of that group, only the information implicit from not being a member of other groups. Again, this is an example of partial information.

In another embodiment, the type of information can adapt, that is, the number and definition of groups can be selected from multiple possibilities. The possibility selected for a given "x" is indicated as part of the information encoded into the symbol "V". For example, if there are four possible definitions, then 2 bits of information within "V" signify which definition is in use.

In the following description, numerous details are set forth to provide a more thorough explanation of the present invention. It will be apparent, however, to one skilled in the art, that the present invention may be practiced without these specific details. In other instances, well-known structures and devices are shown in block diagram form, rather than in detail, in order to avoid obscuring the present invention.

Some portions of the detailed descriptions which follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

A machine-readable medium includes any mechanism for storing or transmitting information in a form readable by a machine (e.g., a computer). For example, a machine-readable medium include read only memory ("ROM"); random access memory ("RAM"); magnetic disk storage media; optical storage media; flash memory etc.

Overview

Within a sequence of parameters, even parameters that are statistically independent and identical, there can be finer variations in local statistics. This is true for even theoretical (analytic) sequences, e.g. independent and identically distributed Gaussian or Laplace random variables. In fact, the statistics of many of the real parameters of interest, e.g. normalized Modified Discrete Cosine Transform (MDCT) Coefficients of many speech and audio coders (even those that are very close of being statistically independent and identical), do often result in significant variations in local parameter statistics. Importantly, these variations tend to be more extreme when measured/viewed at low dimensions, e.g., when considering the local energy of single parameters or subsequences of 2, 3, 5, etc. consecutive parameters. Furthermore, the effect these variations have on quantization performance is often more pronounced at low bit rates.

While these variations are present even when one looks at theoretical sequences of independent and identically distributed (i.i.d.) parameters, i.e., when there is no statistical redundancy, it is not efficient to try to remove or encode all these local variations given the fine and random detail that these variations represent. In fact, at high bit rates these variations should be completely ignored when parameters are i.i.d. This is why in such i.i.d. cases, the prevailing coding approaches ignore such variations, and only indirect exploit them by techniques that use higher dimensional quantizers. Such variations are therefore not the focus of the redundancy and irrelevancy removal steps in traditional coder design and not normally considered when looking at low dimensional quantizers used in these designs. They become important when lower bit-rates are involved.

However, the key observation in this new method is that one does not need to remove, encode, or provide full information on all these local variations. Rather, if one encodes even partial information on these local variations, the information can be exploited by the encoder and decoder for better overall objective quantization and also perceptual (subjective) performance. The reason is that partial information requires less information overhead than more complete information and in general only some variations can be used to an advantage. The variations with an advantage are the ones that are sufficiently "atypical" relative to the average signal statistics. Examples of partial information include, but are not limited to, specifying only some of the variations that exist within a group, specifying imprecisely the general location or degree of the variations, loosely categorizing the variations, etc. At low bit rates, such variations can have a significant impact on performance.

By knowing the presence and approximate location and type of these variations, the encoder and decoder adjusts their coding strategy to improve objective performance, e.g. improve the expected mean square error, and to take advantage of perceptual effects of quantization. In general, a variation from an expected behavior can either signify that subsequences with such variations should either have preferential or non-preferential (even detrimental) treatment. This variation in treatment can be done by creating a non-trivial pattern of bit allocations across a group target vectors (e.g., groups of such i.i.d. vectors). A bit allocation signifies how precisely a target vector (subsequence) is to be represented. The trivial pattern is simply to assign bits equally to all target vectors. A non-trivial (i.e. unequal) pattern can increase both objective performance, e.g., mean square error, and allows one to effectively use perceptually-relevant patterns and noise fill.

Therefore, in one embodiment, underlying base methodology is to create this partial information, information that is not based necessarily on any statistical structure, use of the partial information to create non-trivial patterns of bit assignments, and use of patterns effectively and purposefully with noise-fill and perceptual masking techniques.

FIG. 1 is a flow diagram of one embodiment of a quantization (encoding) process. The process is performed by processing logic at the encoder. The process is performed by processing logic that may comprise hardware (circuitry, dedicated logic, etc.), software (such as is run on a general purpose computer system or a dedicated machine), or a combination of both.

Referring to FIG. 1, the process begins with an input of a target vector "x" 120 to be encoded as well as a target global fidelity criterion "B" 121. The global criteria is simply the criterion (or resource in bits) that is to be applied to the total vector. Both the target and global criterion are assumed generated in earlier coding stages of redundancy and irrelevancy removal. Target vector "x" 120 consists of a sequence of "M" symbols. Target global fidelity "B" 121 is known by the decoder, pre-determined and/or noted from information (bits) sent in the bitstream from earlier coding stages.

Processing logic initially interleaves the target vector (processing block 101). This is optional. In one embodiment, the interleaving is done by an interleaving function. In such a case, information "I" specifying this function (represented as a sequence of bits) is packed into the bitstream and sent to the decoder. Note, if the interleaving function "I" is fixed or known apriori at the decoder, for example as assumed in "B" above, no information needs to be sent to the decoder. The interleaving has many uses, one being to potentially randomize blocking (localized area) effects of quantization.

Processing logic then divides the target vector 120 into a number (greater than 1) of sub-sequences of symbols for classification (processing block 102). In one embodiment, this division (referred to herein as "Division 1") is a function, at least in part, of the fidelity criteria "B." For example, the length of subsequences, the number of subsequences can be a function of "B". In one embodiment, the division is a function, at least in part, of the dimension "M" of the target 120. In yet another embodiment, the division is a function of any other side-information from previous coding stages. Note that the division need not be a function of any of them. Regardless, it is assumed that the decoder knows all relevant information and thus can recreate information on the parsing of Division 1. Note, Division 1 can also be a function of another division referred to herein as "Division 2," which is described below and used when quantizing (encoding) the subsequences.

Processing logic analyzes these subsequences to determine if any subsequence represents and/or contains a variation in behavior that is of interest (processing block 103). Such "atypical" subsequences, subsequences with "atypical" variations, are noted and the indices of some are selected for inclusion in the partial information that is sent to the decoder. Note, subsequences that do not have the behavior of interest may also be selected for such classification. This can be done if such an imprecise (partial) classification is in fact more efficient than the correct classification. For example, forcing an algorithm to specify a fixed preselected number, say "u", or subsequences from the total of "v" subsequences requires less information than allowing one to select flexibly either 1, 2, . . . , or u of such subsequences.

Processing logic encodes information on the indices of "atypical" subsequences and possibly the type of variation they represent into a parameter "V" (processing block 104). This parameter is represented by a sequence of bits to be packed into the bitstream. In one embodiment, mentioned above, this parameter defines the membership of the subsequences in different groups. It is not necessary that all subsequences are assigned to a group. It is not necessary that subsequences in a group have to actually have or represent the same "atypical" variations. Membership in a group only indicates that one can treat these subsequences as if they had such a variation. For example, it may be more efficient to give more subsequences preferential treatment than to spend resources specifying and limiting which subsequences preferential treatment.

To encode target vector 120, processing logic also divides the target into subsequences y(1), . . . , y(n) (processing block 106). This division (referred to herein as "Division 2") does not have to be the same as the division (Division 1) used in analyzing the variations within target vector 120. As with Division 1, in one embodiment, Division 2 is a function of "B" and "M" or any other side information sent from previous coding stages. In one embodiment, Division 2 is a function of "V". For simplicity of illustration, it is assumed that these subsequences are each of "p" symbols. If this division is variable, or a function of any other parameter not present at the decoder at this stage in the decoding, additional information will have to be sent to the decoder in the form of bits to completely describe this division.

Processing logic then uses the fidelity target "B" and partial information parameter represented by "V" to generate a refined fidelity criteria f(1), . . . , f(n) for the target subsequences in Division 2, where f(k) applies to the target y(k) (processing block 105).

Perceptual enhancements can be implicitly represented in the fidelity criteria f(1), . . . , f(n) by further refinements (permutations on the assignments) as discussed below.

Optionally, processing logic tests whether there is new information to further refine the criteria (processing blocks 108) and, if so, determines whether the quantization information obtained as the quantization process proceeds (part of the information that is sent to processing block 115) can actually refine the criteria (processing block 109). If so, processing block sends the information to processing block 105. This optional iterative step may improve performance in some cases. In one embodiment that includes processing block 108 and 109, the quantized version of y(k)'s can directly be used to change the quantization for future y(k)'s. Note, that in the inverse operation in the decoder the quantized versions of y(k)'s are recovered in the same order as at encoding, and so the process can be repeated exactly at the decoder. One adaptation is simply to use the quantized y(k)'s known at a given time to estimate the actual energy of the original y(k)'s. This provides information possibly about the energy of the remaining y(k)'s and thus this information can be used to adapt quantization techniques. Often the entire vector "x" has a given total expected energy due to the original statistical normalization process from earlier encoding steps. This makes such an estimation possible. In another embodiment, the estimated energy of prior y(k)'s can indicate the potential perceptual significance, or perceptual relevance, of future y(k)'s.

Processing logic quantizes the subsequences y(1), . . . , y(n) in Division 2 (using any preferred quantization method, for example classic scalar or vector quantization techniques, according to the fidelity criteria f(1), . . . , f(n) (or any perceptual refinement thereof) (processing block 107). The classic techniques map a subsequence "y(k)" to an index in a codebook. The codebook design, for example the number of entries in the codebook and its members, is a function of f(k). The index specifies the unique entry in the codebook that should be used to represent an approximate version of the subsequence "y(k)".

Processing logic packs the quantization indices in a known order into the parameter "Q". This parameter can simply be the collection of all indices, or some one-to-one unique mapping from the collection of indices to another parameter value (processing block 115) and sends the information as part of the bit stream to the decoder as a sequence of bits (processing block 110).

Figure 2:
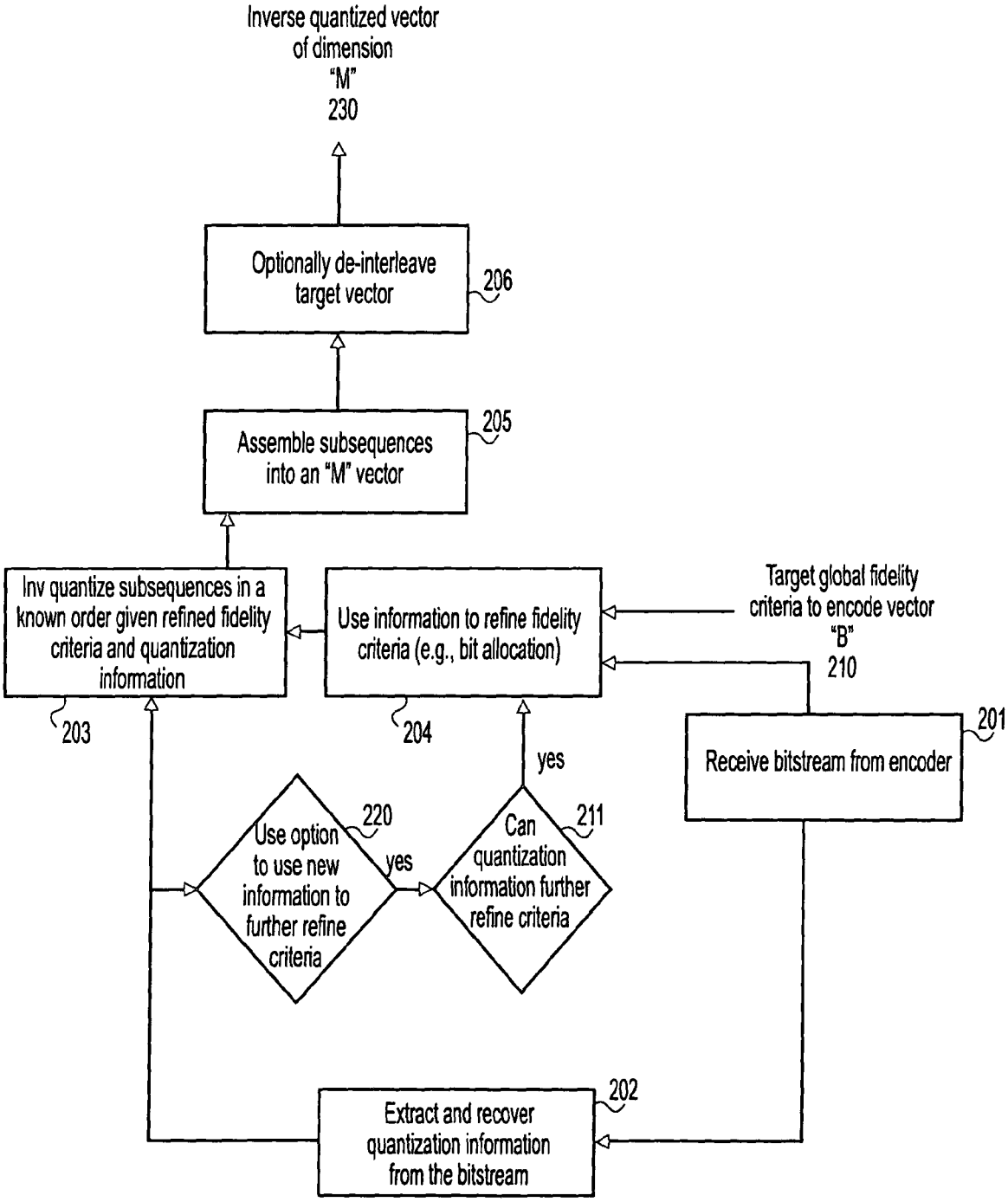
FIG. 2 is a flow diagram of one embodiment of an inverse quantization process.

FIG. 2 is a flow diagram of one embodiment of an inverse quantization process. The process is performed by processing logic at the decoder. The process is performed by processing logic that may comprise hardware (circuitry, dedicated logic, etc.), software (such as is run on a general purpose computer system or a dedicated machine), or a combination of both. Note that this scheme does not have perceptual enhancements.

Referring to FIG. 2, processing logic in the decoder receives the transmitted bitstream from the encoder (processing block 201). The processing logic may receive parameters from earlier coding stages that may (or may not) be necessary, e.g. "B" and "M".

Processing logic extracts the parameter "V" from the bitstream and uses this parameters (and possibly others like "B" from earlier decoding stages) to generate the fidelity criteria f(1), . . . , f(n) (e.g., the bit allocation) used at the encoder (processing block 204).

Using f(1), . . . , f(n), the processing logic is able to take "Q" and extract and recover the quantization indices from the bitstream (processing block 202).

Processing logic uses this fidelity criteria along with the parameters "Q" estimated from the bitstream in processing block 202 to recover quantized versions w(1), . . . , w(n) of the targets (subsequences) y(1), . . . , y(n) (processing block 203). This is done as mentioned by recovering all the quantization indices. That is, the processing logic inverse quantizes subsequences (extracts the necessary codebook entries given the recovered indices) in a known order given a refined fidelity criteria and quantization information.

In one embodiment, processing logic uses the estimated quantization information to test whether there is new information to further refine the fidelity criteria (processing block 220). If so, processing logic tests whether the information can further refine the fidelity criteria (processing block 211). An iterative procedure for doing that is described above. If so, processing block sends the quantization information to processing block 204, which refines the fidelity criteria (e.g., the bit allocation) and modifies the extraction of future quantization indices accordingly.

Using the Division 2, assumed known at both the encoder and decoder (and possibly a function of other parameters), processing logic assembles w(1), . . . , w(n) into a decoded vector of length "M" (processing block 205).

Processing logic optionally de-interleaves this decoded vector, if necessary (if interleaving is done by the encoder), and this produces inverse quantized vector "w" 230, which is an "M" dimensional quantized version of the target "x" (processing block 206).

Other Embodiments of the Present Invention

Figure 3:
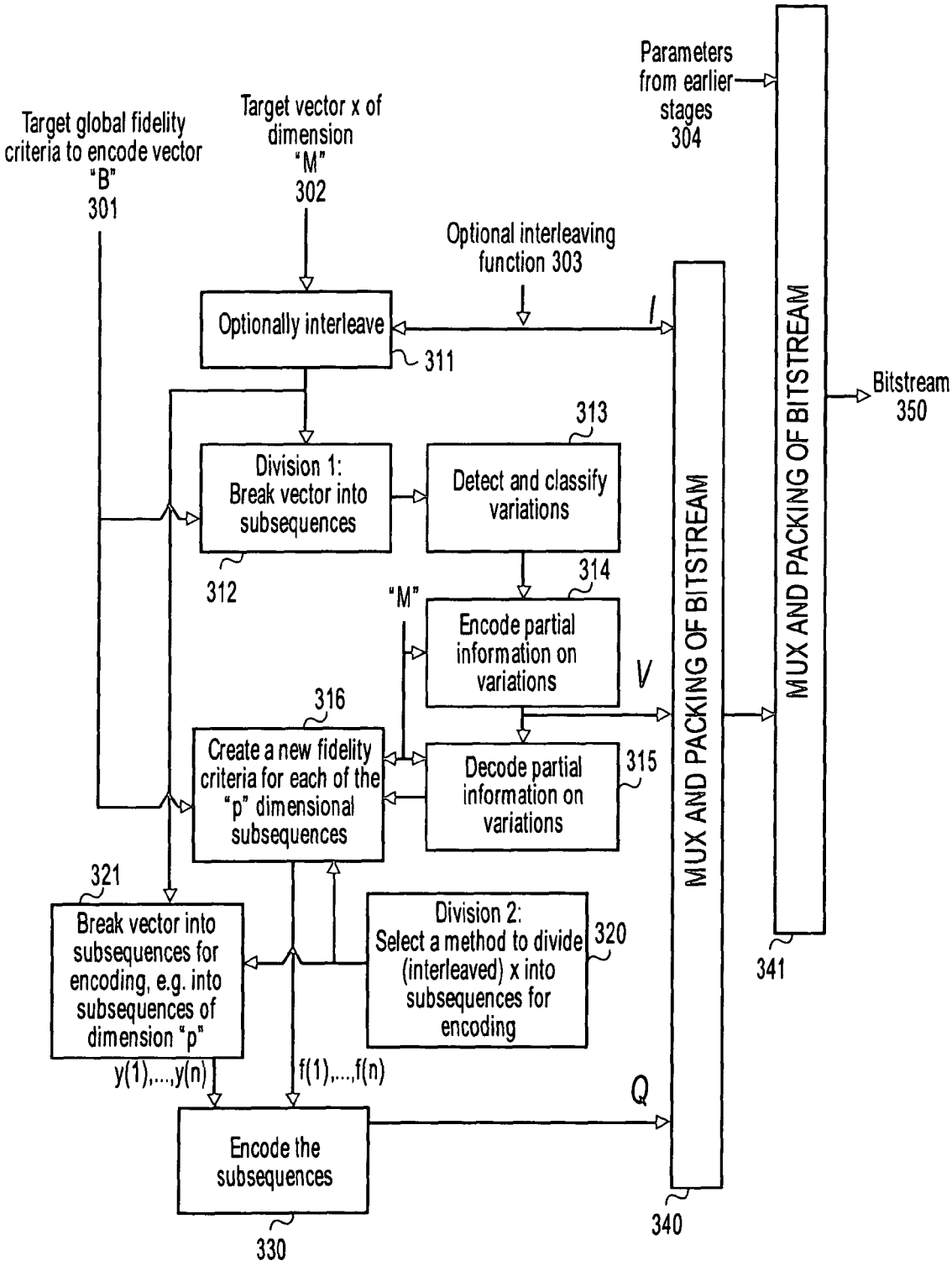
FIG. 3 illustrates a flow diagram of one embodiment of an encoding process.

In an application of the teachings described herein, there are many possible options for the creation and use of this partial information FIG. 3 illustrates a flow diagram of one embodiment of an encoding process that uses partial information. The process is performed by processing logic at the encoder. The processing logic may comprise hardware (circuitry, dedicated logic, etc.), software (such as is run on a general purpose computer system or a dedicated machine), or a combination of both.

Referring to FIG. 3, the process begins by processing logic optionally interleaving a target vector 302 of dimension "M" 302 (processing block 311). The interleaving is done based on interleaving function (I) 303. Interleaving function (I) 303 is represented by bits. That is, "I" represents the bits required to describe completely the interleaving function (which can be 0).

In one embodiment, no interleaving function is used, and the fidelity criteria "B" specifies the number of bits that is to be used to encode the target x. It can be assumed without loss in generality that "B" is equivalent to specifying "B"-bits are to be used to encode target vector 302.

The target "x" consists of "M" symbols. In one embodiment, each symbol itself represents a vector. In the simplest case, a single symbol is a real or complex valued scalar (number).

After optionally interleaving, processing logic performs Division 1. To that end, processing logic breaks the vector 302 into subsequences (processing block 312), detects and classifies variations (processing block 313) and encodes partial information on the variations in response to information regarding dimension "M" (processing block 314). One output of the result of encoding are the bits required to describe completely the partial information. This is represented as V in FIG. 3.

In one embodiment, sub-sequences in Division 1 are non-overlapping and defined simply as consecutive sub-sequences each consisting of "m" symbols. In one embodiment, the value "m" is a function of "B" and "M". There are therefore q=M/m (assume q is an integer) such sub-sequences in Division 1. For purposes herein, these subsequences are referred to as x(1), . . . , x(q). In another embodiment subsequences in Division 1 can overlap.

Processing logic decodes the partial information and the variations (processing block 315) based on the input information specifying dimension M.

At processing block 316, processing logic creates the new fidelity criteria for each of the "p" dimensional subsequences using the target global fidelity criteria to encode the vector, B 301, the dimension M, the result of decoding the partial information of variations from decode partial information block 315 and an output of processing block 320. In processing block 320, processing logic performs Division 2 which includes selecting a method to divide (interleave) target vector 302 into subsequences for encoding. In one embodiment, Division 2 is a refinement of Division 1 in which each "m" symbol vector x(k) is divided into "a" subsequences each of dimension "p" with a=m/p assumed to be an integer. For purposes herein, these Division 2 subsequences are referred to as x(k,1), . . . , x(k,a). Therefore, there are n=a*q total "p"-dimensional subsequences in Division 2. The results of creating the new fidelity criteria are sent to processing block 330.

At processing block 321, processing logic breaks the vector into subsequences for encoding based on the method selected at processing block 320. In one embodiment, the sequences for encoding are subsequences of dimension "p". The subsequences, referred to as y(1) . . . , y(n).

In response to the outputs of processing blocks 321 and 316, processing logic encodes the subsequences (processing block 330). The encoded subsequences are each described by parameters (e.g., quantization indices) that collectively comprise the information "Q". This "Q" along with the bits required to describe completely the partial information V are output and sent to mux and packing logic 340.

Multiplexing and packing logic 340 receive the bits that are required to completely describe the interleaving function, "I", the bits required to describe completely the partial information, "V", and the bits "Q" required to describe completely the quantization which can be interpreted given "V" (and possibly "I"). In response thereto, multiplexed and packed into a bitstream by logic 340. The output of mux and packing logic 340 sent to mux and packing logic 341 which multiplexes and tacks the information along with parameters from earlier stages 304 into a bitstream 350.

Figure 4:
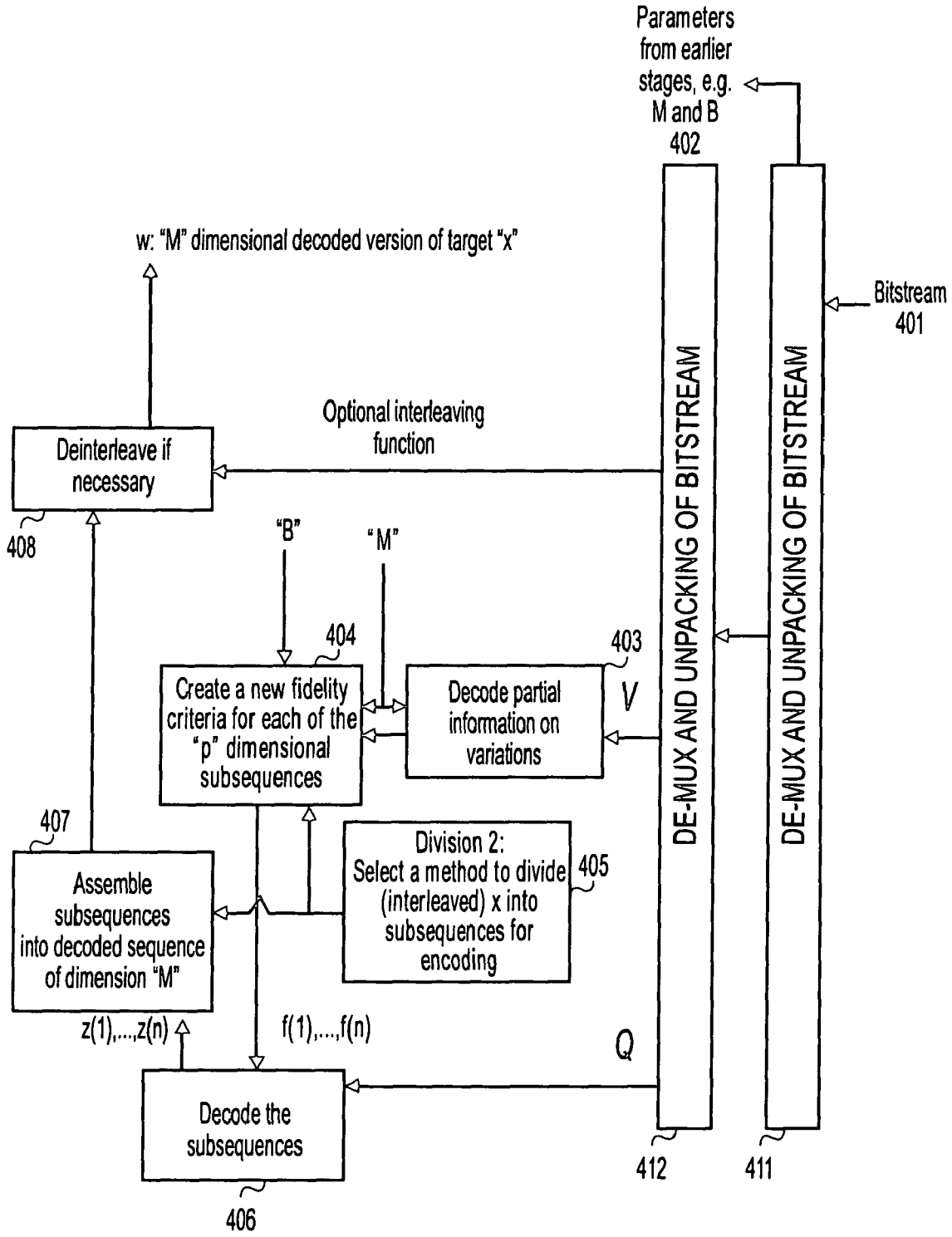
FIG. 4 is a flow diagram of one embodiment of the decoding process.

FIG. 4 is a flow diagram of one embodiment of the decoding process. The process is performed by processing logic in the decoder. The process is performed by processing logic that may comprise hardware (circuitry, dedicated logic, etc.), software (such as is run on a general purpose computer system or a dedicated machine), or a combination of both.

Referring to FIG. 4, bitstream 401 is received by demux and unpacking logic 411 which produces a bitstream 420 and parameters for earlier stages (e.g., M and B) 402. Bitstream 420 is input into demux and unpacking logic 412 which performs de-multiplexing and unpacking of the bitstream to produce I, V, and Q, where I are the bits required to describe completely the interleaving function, V are the bits required to describe completely the partial information, and Q are the bits required to describe completely the quantization given V. The V bits are sent to processing block 403 where processing logic decodes the partial information on variations in response to an input M that represents the dimensionality of the target vector. The results of the decoding are used at processing block 404, where processing logic creates a new fidelity criteria for each of the "p" dimensional subsequences in response to target global fidelity criteria B and the dimension M of the target vector. In one embodiment, the new fidelity is also created in response to the selection of the method used to divide the target vector into subsequences for encoding that is specified by processing block 405. The new fidelity criteria, represented as f(1) . . . , f(n) is sent to processing block 406.

At processing block 406, processing logic decodes the information represented in "Q" from demux and unpacking logic 412 relating to each of the subsequences in response to the fidelity criteria specified by processing block 404. The decoded subsequences are sent to processing block 407 where processing logic assembles the retrieved subsequences into a decoded sequence of dimension M. Processing logic assembles the subsequences in response to the method to divide (interleave) target X into subsequences as specified by processing block 405.

Thereafter, processing logic performs any necessary deinterleaving (processing block 408). This is done in response to interleaving function specified by I output from demux and unpacking logic 412. The output of processing block 408 is the M dimensional decoded version of target X.

Variation Measure

A measure of variation is computed for each of the "m" dimensional vectors x(1), . . . , x(q). The measure has to match the perceptual criteria and quantization scheme that is used. In one embodiment, the quantization scheme is based on fixed-rate vector quantizers, and the criteria is the energy of each subsequence.

Processing logic decides on a discrete number "D" of categories in which to classify the subsequences based on the measure. Members of each category represent vectors that deviate from the typical behavior in some sense. In one embodiment, a single category is used in which the subsequence with the maximum variation in the measure, e.g. energy, is noted. In this case, the category has a single member. In another embodiment, two categories are used: the first category being the "d" vectors with the highest energies and the second category being the "h" vectors with the lowest energy. In this case, the first group has "d" members and the second group has "h" members.

Note that the categories that are used often do not provide precise information on the value of the measure under consideration, e.g. the energy value of the subsequences. In fact, it does not necessarily, as in this case when "a">1, provide information at the granularity of Division 2. All that is necessary is that the variation differentiates one or more subsequences from the rest within the group of sequences under consideration. That is, categories are for subsequences which are "atypical" given the limited samplings representative of such vectors at low dimension when compared to other subsequences. The examples above represent categories that are being used in practice. In one embodiment, the categories are fixed. In another embodiment, the categories are a function of information from earlier coding stages, e.g. "B" and are assumed known by the decoder and encoder. If the categories themselves change, additional side-information is used to signal the information to the decoder. This side-information can simply be included as part of "V" as previously described. In uses of this method, it can suffice to have the categories be mainly a function of "B", "M" and "m". Additional side-information, as described below can also be useful in specifying the categories (and "m"), and this can be shown to be advantageous in some situations The membership in each of the categories is encoded. To perform this encoding, first recall that there are originally "q" m-dimensional subsequences in Division 1, only some of which may be categorized. Assume that there are "D" categories with a pre-determined fixed number d(1), . . . , d(D) members in each category. Specifying this categorization requires no more than "V" bits of information with:

$$V=\log 2(\text{product}_{(k=1,\ldots,D)}{}^{q-h(k)}C_{d(k)})$$

$$\text{where } h(k)=\text{sum}(j=0,\ldots,k)d(j) \text{ with } d(0)=0$$

$$\text{and } {}^{N}C_{g}=N!/(g!(N-g)!)$$

For example, with two categories, each with only 1 member, log 2(q(q−1)) bits is sufficient to describe the membership in the two categories of interest. This would constitute the information "V" in FIG. 3 and FIG. 4. Note that q−2 subsequences are implicitly in this example included in a third category for which no information is given, besides that these subsequences are not in the two categories of interest.

An example of partial information comprises a definition of the "D" categories, membership in the "D" categories, and the fact that many sequences may not be put into a "atypical" category partial information.

Assume "B" is simply "B" bits, and "V" is simply represented by "V" bits. In one embodiment, to create the bit assignments f(1), . . . , f(n) using processing block 316 or 404, the (B-V) bits assigned to the target vector "x" are initially divided in a way that is considered equal among the "q" "m"-dimensional subsequences x(1), . . . , x(q) of Division 1. This would make sense in the case that there is no partial information since the earlier coding stages assume, or by nature and design try to make, the subsequences to be all statistically equal and the target vector "x" to have no structure.

However, the additional partial information enables one to do better, particularly at low bit rates. As a function of "B" and "m", and the categories selected and information "V", the bit allocation is modified to create an unequal assignment across the q subsequences. This creates a coarse initial unequal bit allocation F(1), . . . , F(q) across the "q" m-dimensional subsequences. For example, if there are two categories: Category 1 being the subsequence with maximum energy and Category 2 being the subsequence with minimum energy, an algorithm could simply remove a given number of bits from subsequence of Category 2 and give to the subsequence in Category 1. The number of bits that is to be transferred is referred to herein as the "skew". In another example, if there are two categories, Category 1 being the subsequence with maximum energy and Category 2 being the subsequence with the next maximum energy, an algorithm could simply remove a given number of bits from any or all of the remaining vectors and give the bits to Category 1 and Category 2, possibly unequally. Again, the number of bits that is to be transferred is referred to as the "skew". In both of the examples above, it has been found that it is sufficient for the "skew" to be implicit on "M", m"and "B". That is, "M", "m" and "B", variables known to both the encoder and decoder, along with the categories used, are sufficient to define the skew. When bits are removed from many other vectors that are not differentiated by the partial information, as in this second example, the bit are removed as uniformly as possible across these vectors to make up the skew.

Given an assignment F(k), the "a" Division 2 subsequences x(k,1), . . . , x(k,a) within a subsequence x(k) are either treated as equally as possible within the group. The partial information that is available does not apply at a refinement of bit assignments within any subsequence x(k) and so equal treatment is logical and achieved by dividing the bits up as equally as possible between the "a" subsequences. Doing this for all "k" refines the coarse bit assignments of F(1), . . . , F(q) bit to the x(1), . . . , x(q) down to "n" assignments f(1), . . . , f(n) that apply to the "n" "p"-dimensional subsequences x(1,1), . . . , x(q,a), with n=q*a. Note that though the partial information that is available does not apply at a refinement of bit assignments within any subsequence x(k) from a perceptual point of view, the scheme can look at actual assignments within a group and permute (arrange them) to have a perceptual advantage. This is described below in conjunction with FIG. 6 and FIG. 7.

The new bit allocations are used to direct the quantization of the "n" targets x(1,1), . . . , x(q,a). Actual quantization is done by using p-dimensional quantization on the n=m*q "p"-dimensional vectors: x(1,1), . . . , x(1,a), x(2,1), . . . , x(q,a). The actual quantization based on a bit assignment to any given x(k,j) is done using classic quantization techniques, as previously described, e.g., scalar or vector quantization.

Additional Perceptual Enhancements

In one embodiment, the encoding scheme of FIG. 3 and decoding scheme of FIG. 4 are modified to add the ability to make perceptual refinements. These perceptual refinements patterned bit-assignments and/or noise-fill. One reason these approaches apply are based on a few properties of the new methodology. Namely, assignments f(i), f(j), f(l) to subsequences within the same category (i.e. to subsequences within the same x(k) or subsequences of different x(k) that are in the same category) can be permuted with no loss in expected (average) objective (e.g., mean square error) performance. The partial information does not distinguish such vectors from one another by definition.

Another reason these approaches apply is that the process creates an unequal bit assignment and often many of the assignments f(n) are zero when the process is used at sufficiently low bit rates. Even when a non-zero assignment F(k)>0 to a subsequence x(k) is broken down in the "a" different assignments for the subsequences x(k,1), . . . , x(k,a), then some subsequences may get 1 bit more than another unless F(k) is an integer multiple of "a". If F(k)<a, then often some vectors necessarily get a zero-bit assignment.

Figure 5:
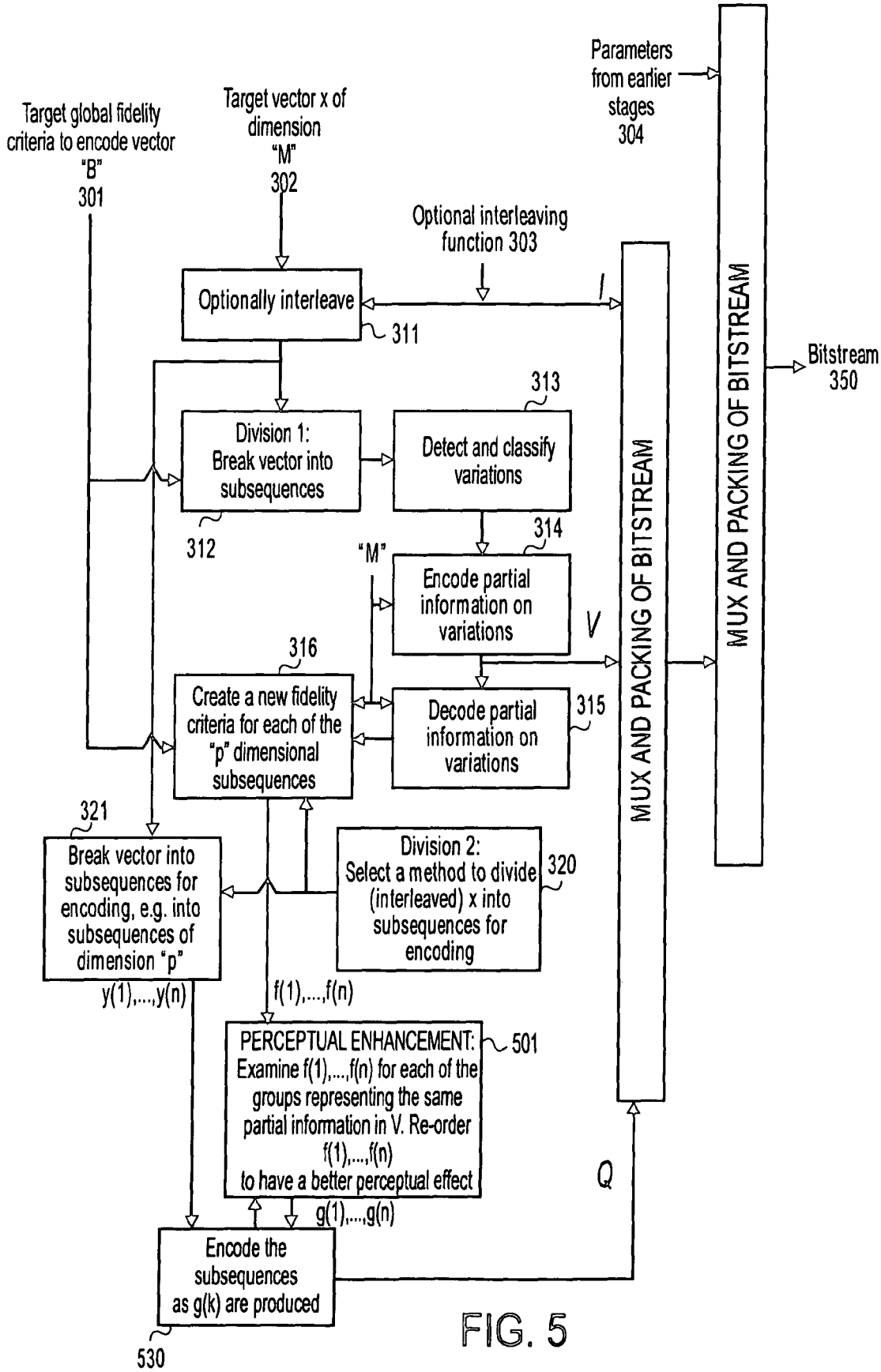
FIG. 5 illustrates a flow diagram of one embodiment of an encoding process having an additional perceptual enhancement to the bit allocation.
Figure 6:
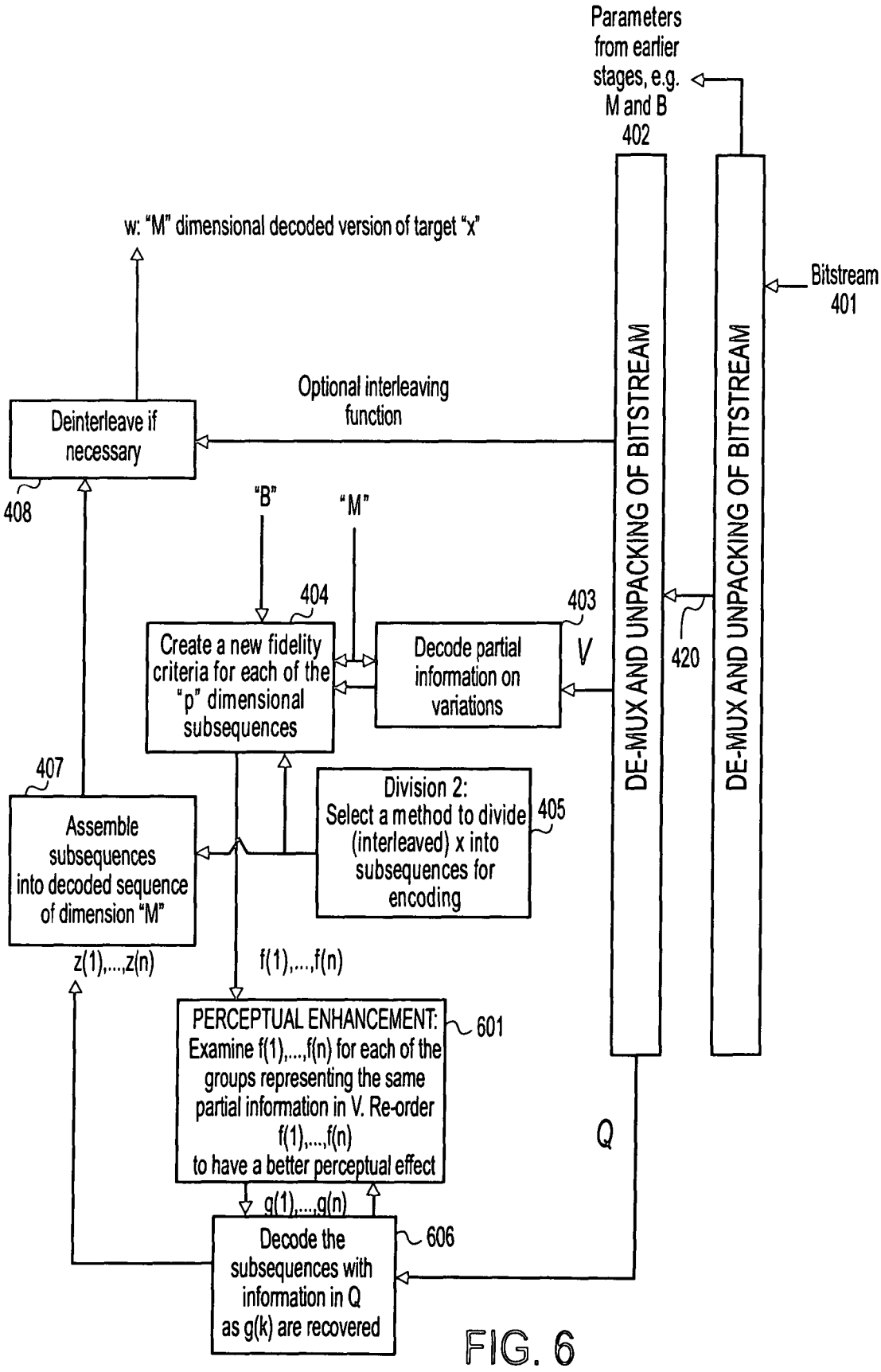
FIG. 6 illustrates a flow diagram of one embodiment of a decoding process having an additional perceptual enhancement to the bit allocation.

The use of patterned bit-assignment is directly linked to the first of these properties and the process is illustrated for the encoder and decoder in FIG. 5 and FIG. 6. This process is to take the assignment f(1), . . . f(n) and to create a new assignment g(1), . . . , g(n) which is a restricted permutation of this assignment. Permutation of assignments is only allowed between subsequences of the same category.

FIG. 5 illustrates the modification of FIG. 3 where perceptual enhancement block 501 examines the output of the newly created fidelity for each of the subsequences and for each of the groups representing the same partial information in V. Processing logic then re-orders f(i), . . . f(n) to have better perceptual effect. The reordered assignment is sent to encoding block 530, which encodes the subsequences as they are produced. The same is similar in FIG. 6.

One embodiment of the incorporation of permutation is given below.

Subsequences of the single category having the highest average bit allocation per subsequence are identified. If possible, these assignments are permuted to have the greatest possible perceptual effect. In one embodiment, if the vectors x(1,1), . . . , x(q,a) represent frequency domain vectors, and thus x(k) a sequence of symbols comprising a frequency band, the high bit assignments are clustered close together in frequency, e.g. take a random assignments f(j), . . . , f(j+s)=[5,4,5,4,4] and order into g(j), . . . , g(j+s)=[4,4,5,5,4]. In this case the general rule could be to make the cluster concentrated in the center of the frequency band. Another rule would be to cluster assignments near the edge of the band, e.g. g(j), . . . , g(j+s)=[5,4,4,4,5]. The choice of which to option to use can depend on other signal characteristics (information) encoded (represented) in previous stages as well as the actual values of f(k). That is, the permutation is entirely implicit on existing information.

After categorization, the targets are quantized. Sometimes it is advantageous in a way with those receiving the maximum bit allocation being quantized first. Note, this information is packed first into the bitstream in Q.

Based on the values of g(j), . . . , g(j+s) and possibly the quantized indices in Q, the perceptual masking properties of the decoded vectors w(j), . . . , w(j+s) are evaluated.

Afterwards, look at the next target subsequences that will be most impacted by this masking based on the remaining values of f(k). Permute their bit-assignments, if possible, to take advantage of as much as possible, or to enhance as much as possible, the masking effect from the already encoded vectors. For example, if it is determined that the area covered by g(j), . . . , g(j+s) does have a non-trivial masking effect on adjacent areas and an adjacent area has f(j−t), . . . , f(j−1)=[1,0,1,0,1] then one procedure would be to cluster the few non-zero assignments to be far from the already coded area and not to use noise-fill (or used noise-fill at very low energy), i.e. g(j−t), . . . , g(j−1)=[1,1,1,0,0].

Figure 7:
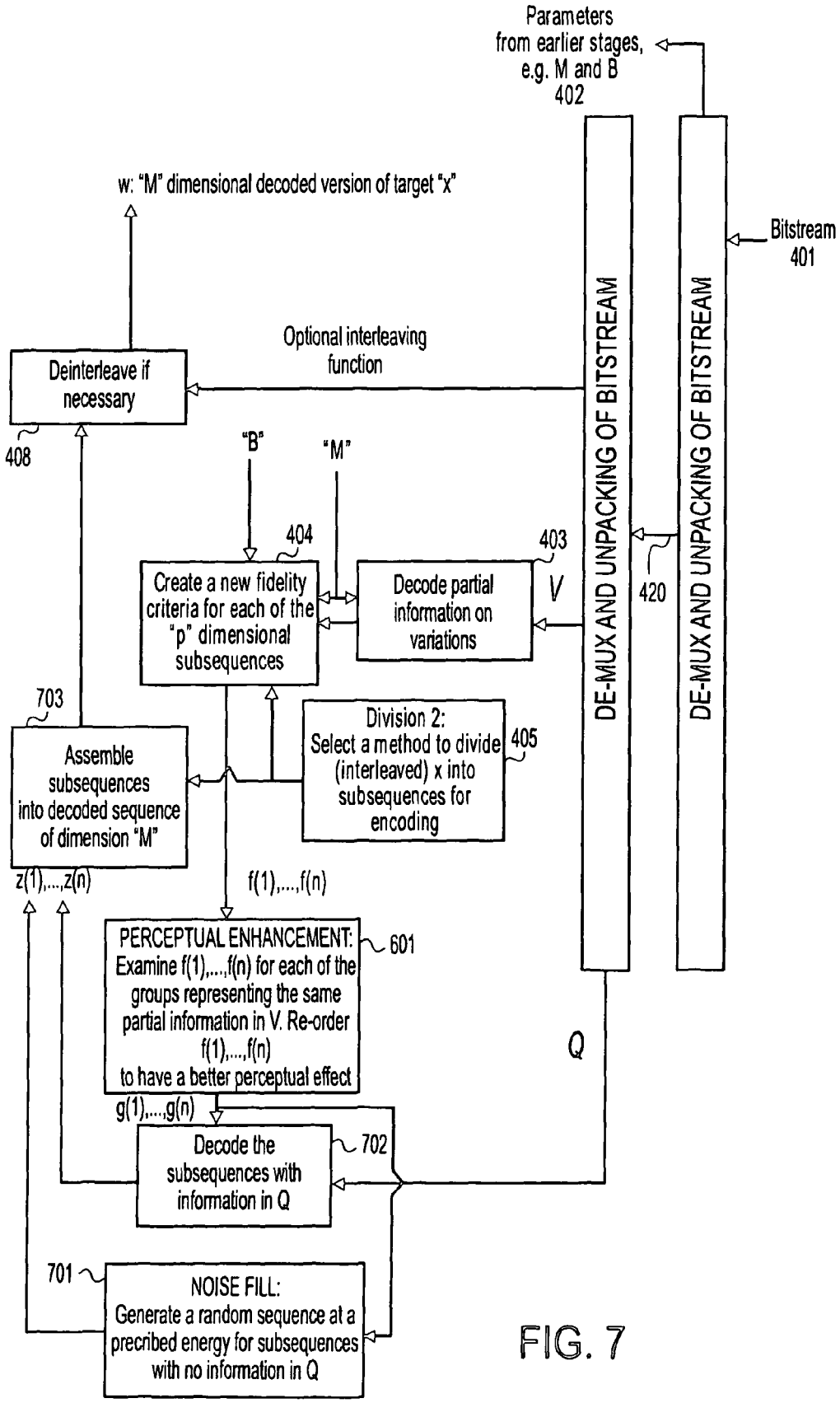
FIG. 7 illustrates a flow diagram of one embodiment of a decoding process having a noise-fill operation.

Iterate till the entire g(1), . . . , g(n) assignment has been generated and all subsequences are encoded. Noise fill depends on the second property and can be used with or without adaptation to the patterned bit assignments as in FIG. 7. Referring to FIG. 7, noise-fill processing block 701 generates a random sequence at a prescribed energy for subsequences with no information in Q.

Noise-fill effectively increases the variability in potential decoded patterns often at the expense of increase mean square error. The increased variability is perceptually more pleasing and is created by generating random patterns, at a given noise energy level, for areas in which there are zero bit assignments. When used in this scheme without consideration to the exact pattern of g(1), . . . , g(n), the noise fill is simply generated at a selected level for subsequences receiving zero-bit assignments. When the scheme adapts to the exact pattern g(1), . . . , g(n), it can do so by changing the energy level of the noise fill in different areas. In particular, if an area with a zero-bit assignment is considered perceptually masked by another areas (coded with a non-zero bit assignment), then the decoder may not decide to use any noise-fill in that area or to decrease the energy of the noise-fill.

Performance Enhancements to the Embodiment

There are further performance enhancements that may be used.

Figure 8:
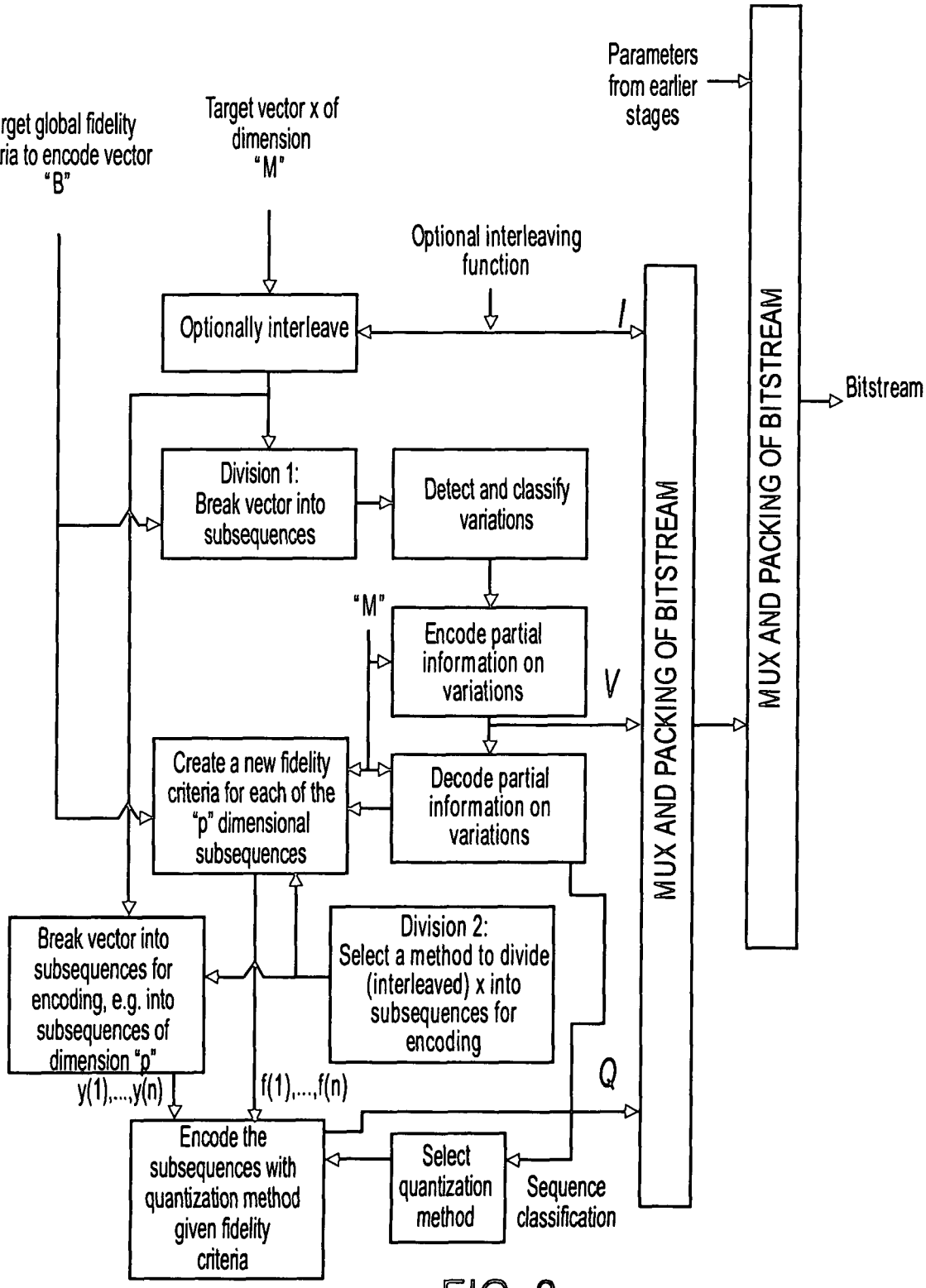
FIG. 8 illustrates a flow diagram of one embodiment of an encoding process having adaptive quantization.

The first is to adapt the quantizer used to code a subsequence based on the subsequence's category. This is shown in FIG. 8. To implement this scheme in the case where straightforward vector quantizers (of dimension "p") are used, the scheme would simply have different codebooks for different categories. The codebooks are trained based on classified training data.

A second enhancement is to use two or more embodiments of the scheme simultaneously, e.g. use different "m", different "p", different categories etc, for each of the embodiments, encode using each embodiment, and then select information from only one embodiment for transmission to the decoder. If "r" different embodiments are tested then an addition log 2(r) bits of side-information is sent to the decoder to signal which embodiment has been selected and sent.

Additional Embodiments

There are a number of additional embodiments. In one embodiment, the subsequences in Division 1 are overlapping. The overlapping itself can be used to increase the resolution of information provided by the categories. For example, if two overlapping subsequences are members of the same category, then it could be likely that the overlap region (common to the two subsequences) is the area that is creating the atypical variation. Recall, to balance the information between the "V" bits to describe the category and the "(B-V)" bits to do the quantization it could be that subsequences in a group may not in fact have the variation that the group is trying to signify. However, in such cases it may be more efficient to put such subsequences in such a group, treat them as if they had the variation, rather than to spend more information trying to provide information saying they are not in the group. Overlapping groups may be a means to refine such information in an incremental way without being exact.

In one embodiment, the target fidelity criteria "B" can be specified in means other than bits. For example, in one embodiment, the target fidelity criteria "B" represents a bound on the error for each target vector.

In one embodiment, the value "m" is a function of information from earlier stages, e.g. "M" and "B". It may be advantageous to provide additional adaptation in this value through use of additional side information and or use of other parameters. For example, one such scheme uses two potential values of "m" and signals the final choice used for a given sequence to the decoder using 1 bit.

In one embodiment, the interleaver is fixed or a function of information from earlier coding stages (requiring no side information) or variable (requiring side information).

In one embodiment, the new fidelity criteria on "p" subsequences do not conform to the global fidelity criteria "B". For example, it could be that the additional partial information is enough to motivate a change in the "B" criteria calculated from earlier stages.

In one embodiment, the process of generating new perceptual patterns g(1), . . . , g(n) is not an incremental process that occurs as quantization is being done. The pattern g(1), . . . , g(n) can be generated directly from f(1), . . . , f(n) without any information from Q. This increases the resilience of the encoding to bit-errors.

An Exemplary Computer System

Figure 9:
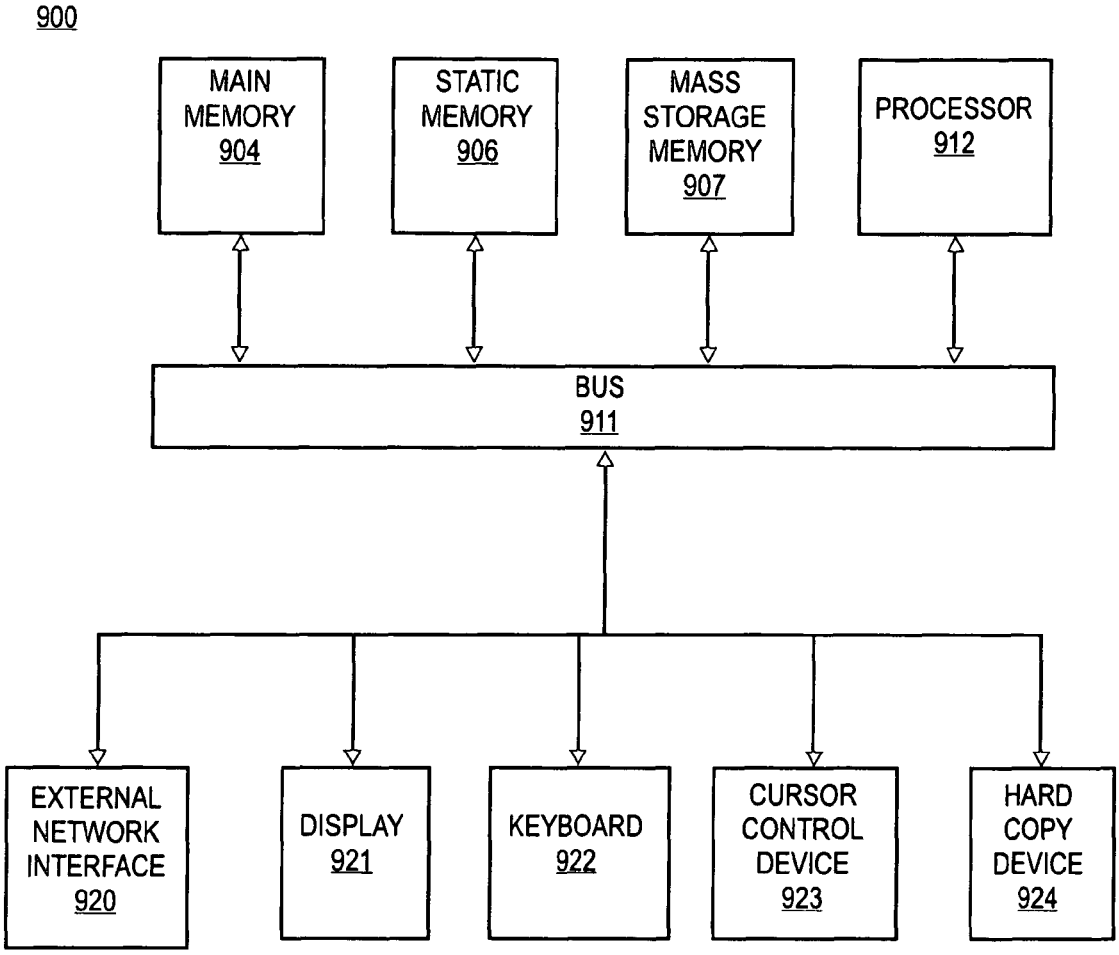
FIG. 9 is a block diagram of one embodiment of a computer system.

FIG. 9 is a block diagram of an exemplary computer system that may perform one or more of the operations described herein. Referring to FIG. 9, computer system 900 may comprise an exemplary client or server computer system. Computer system 900 comprises a communication mechanism or bus 911 for communicating information, and a processor 912 coupled with bus 911 for processing information. Processor 912 includes a microprocessor, but is not limited to a microprocessor, such as, for example, Pentium™, PowerPC™, Alpha™, etc.

System 900 further comprises a random access memory (RAM), or other dynamic storage device 904 (referred to as main memory) coupled to bus 911 for storing information and instructions to be executed by processor 912. Main memory 904 also may be used for storing temporary variables or other intermediate information during execution of instructions by processor 912.

Computer system 900 also comprises a read only memory (ROM) and/or other static storage device 906 coupled to bus 911 for storing static information and instructions for processor 912, and a data storage device 907, such as a magnetic disk or optical disk and its corresponding disk drive. Data storage device 907 is coupled to bus 911 for storing information and instructions.

Computer system 900 may further be coupled to a display device 921, such as a cathode ray tube (CRT) or liquid crystal display (LCD), coupled to bus 911 for displaying information to a computer user. An alphanumeric input device 922, including alphanumeric and other keys, may also be coupled to bus 911 for communicating information and command selections to processor 912. An additional user input device is cursor control 923, such as a mouse, trackball, trackpad, stylus, or cursor direction keys, coupled to bus 911 for communicating direction information and command selections to processor 912, and for controlling cursor movement on display 921.

Another device that may be coupled to bus 911 is hard copy device 924, which may be used for marking information on a medium such as paper, film, or similar types of media. Another device that may be coupled to bus 911 is a wired/wireless communication capability 925 to communication to a phone or handheld palm device.

Note that any or all of the components of system 900 and associated hardware may be used in the present invention. However, it can be appreciated that other configurations of the computer system may include some or all of the devices.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

I claim:

1. A method comprising:

partially ordering, by an encoder of a processing device, a first plurality of subsequences of a target vector by arranging subsequences of the first plurality of subsequences into a plurality of ordered groups in accordance with a measure of the target vector available only to the encoder and not available to a decoder, wherein membership in an ordered group represents a variation of behavior of subsequences of the first plurality of subsequences, wherein order of groups in the plurality of ordered groups does not provide information on element by element values of the target vector itself, wherein the subsequences in each ordered group are not differentiated and are given equal priority within the ordered group, and wherein information specifying the partial ordering of the first plurality of subsequences into the plurality of ordered groups is explicitly encoded into a number of bits sent to the decoder that represents an arrangement of the first plurality of subsequences into the ordered groups, wherein the bits specify only the partial ordering and define only the subsequences in each ordered group and the order of the plurality of ordered groups, and wherein the partial ordering is fully recoverable using the information;

dividing, by the encoder, the subsequences of the first plurality of subsequences into a second plurality of subsequences;

creating, by the encoder, a subsequence fidelity criterion for each subsequence of the second plurality of subsequences based at least in part on the partial ordering of the first plurality of subsequences represented through the arrangement of the first plurality of subsequences into groups; and encoding, by the encoder, the second plurality of subsequences, including quantizing the second plurality of subsequences, given each of the subsequence fidelity criterions.

2. The method defined in claim 1 wherein each subsequence fidelity criterion is mapped to a bit allocation, wherein quantizing the second plurality of subsequences is in accordance with the bit allocation, and wherein the bit allocation tries not to differentiate between subsequences of the same group.

3. The method defined in claim 1 further comprising:

mapping the partial ordering of the first plurality of subsequences to a unique index;

encoding the index; and sending the index in the bitstream.

4. The method defined in claim 3 further comprising adding the resulting quantization information of the second plurality of subsequences into the bitstream along with the index specifying the partial order, wherein the index allows a receiver of the bitstream to reconstruct a meaning of the quantization information.

5. The method defined in claim 2 wherein creating each of the subsequence fidelity criterions is based on information derived from classification and includes modifying an existing fidelity criterion that applies only globally to encoding the entire target vector.

6. The method defined in claim 5 wherein the global fidelity criterion is a total number of bits that can be used to encode the target vector, and wherein the subsequence bit allocation conforms to the global fidelity criterion.

7. The method defined in claim 1 wherein the target vector has no assumed redundancy or statistical structure for apparent classification into the ordered groups.

8. The method defined in claim 1 wherein a measure of the variation of a subsequence is not precisely defined, is not sent in the bitstream, and is implied imprecisely through a group membership in one of the ordered groups and through a ordering of the ordered groups.

9. The method defined in claim 1 further comprising grouping one or more types of variations by considering the variation with respect to a statistical norm.

10. The method defined in claim 1 wherein partially ordering the first plurality of subsequences into groups comprises: detecting variations in the first plurality of subsequences, classifying the variations, grouping the variations into two or more groups, assigning subsequences to the groups, ordering the groups, and not transmitting the variations.

11. The method defined in claim 10 wherein arranging the subsequences into a plurality of ordered groups based on the measure of variation is based on a measure of energy.

12. The method defined in claim 1 wherein classifying variations is based on testing performance of quantizing individual targets with all possible refinements of the global fidelity criterion that can be represented by a partial order.

13. The method defined in claim 1 wherein arranging the subsequences into a plurality of ordered groups based on the measure of variation is based on testing a number of possible classification options and the respective bit assignments and selecting the option that has a desired level of performance given a criterion.

14. The method defined in claim 1 wherein arranging the subsequences into a plurality of ordered groups based on the measure of variation is based on trying to maximize the number of the first plurality of sequences that do not receive quantization resources in each of the subsequence fidelity criterions.

15. The method defined in claim 1 further comprising creating an unequal bit assignment across the ordered groups to which the first plurality of subsequences are arranged, wherein the unequal bit assignment is a function of the group and specifies the total number of bits per group.

16. The method defined in claim 15 wherein the bit assignment across the first plurality of subsequences can be directly mapped to the bit assignment across the second plurality of subsequences by dividing the total bit assignment per group as equally as possible among group members.

17. The method defined in claim 15 wherein creating the unequal bit assignment is based on observing a statistical variation between members of different ordered groups in the plurality of ordered groups and observing that there is an order of priority between ordered groups, wherein the observed statistical variation is not specified.

18. The method defined in claim 1 wherein creating the subsequence fidelity criterion comprises generating patterns of bit assignments within each group of subsequences.

19. The method defined in claim 18 wherein creating the-subsequence fidelity criteria comprises:

determining groups of bit assignments for subsequences in the same group; and reordering these bit assignments in a fixed fashion that is not driven by the partial ordering and assumes no priority of subsequences within the group is specified by the partial ordering.

20. The method defined in claim 19 wherein reordering the bit assignments is based on achieving a desired perceptual effect that is not implicit on the partial ordering.

21. The method defined in claim 20 wherein the desired perceptual effect is a perceptual masking property.

22. The method defined in claim 20 wherein the reordering the bit assignments comprises clustering one or more non-zero bit assignments away from an already coded area.

23. The method defined in claim 19 wherein reordering the bit assignments causes subsequences with a maximum bit allocation to be quantized before subsequences with less than the maximum bit allocation.

24. The method defined in claim 1 wherein creating the refined fidelity criterion based on information derived from classification comprises modifying the fidelity criteria to take advantage of perceptual masking effects.

25. The method defined in claim 24 wherein the perceptual masking effects are in one or more of a group consisting of effects in one or more of time and frequency.

26. The method defined in claim 1 further comprising adapting quantizers for encoding the second plurality of subsequences based on the information.

27. The method defined in claim 26 wherein adapting quantizers comprises:

for each subsequence, selecting use of one of a plurality of quantizers based on a category assigned to said each subsequence, the category being defined by group membership in the plurality of ordered groups.

28. The method defined in claim 27 wherein selecting use of one of the plurality of quantizers comprises selecting a codebook for use in quantization based on the group membership.

29. An article of manufacture comprising one or more computer readable media storing instructions which, when executed by a system, causes the system to perform a method comprising:

partially ordering a first plurality of subsequences of a target vector by arranging subsequences of the first plurality of subsequences into a plurality of ordered groups in accordance with a measure of the target vector available only to an encoder and not available to a decoder, wherein membership in an ordered group represents a variation of behavior of subsequences of the first plurality of subsequences, wherein order of groups in the plurality of ordered groups does not provide information on element by element values of the target vector itself, wherein the subsequences in each ordered group are not differentiated and are given equal priority within the ordered group, and wherein information specifying the partial ordering of the first plurality of subsequences into the plurality of ordered groups is explicitly encoded into a number of bits in a stream sent to the decoder that represents an arrangement of the first plurality of subsequences into the ordered groups, wherein the bits specify only the partial ordering define only the subsequences in each ordered group and the order of the plurality of ordered groups, and wherein the partial ordering is fully recoverable using the information;

dividing the subsequences of the first plurality of subsequences into a second plurality of subsequences;

creating a subsequence fidelity criterion for each subsequence of the second plurality of subsequences based at least in part on the partial ordering of the first plurality of subsequences represented through the arrangement of the first plurality of subsequences into groups; and encoding the second plurality of subsequences, including quantizing the second plurality of subsequences given each of the subsequence fidelity criterions.

30. A method comprising:

decoding, by a decoder of a processing device, encoded group membership information from a received bitstream, the group membership information being a number of bits in the bitstream that were explicitly encoded to define an ordering of groups into which a first plurality of subsequences of a target vector were arranged in accordance with a measure of the target vector available only to an encoder and not available to the decoder, wherein the ordering is a partial ordering because membership in a group represents a variation of behavior of subsequences of the first plurality of subsequences, wherein order of groups in the plurality of groups does not provide information on element by element values of the target vector itself, wherein the first plurality of subsequences are unequally assigned across the plurality of groups, wherein the group membership information defines only the subsequences in each group and the order of the plurality of groups, and wherein the ordering of groups is fully recoverable using the group membership information, and wherein the one or more subsequences in each group are given equal priority within the group;

generating, by the decoder based at least in part on the decoded group membership information, a subsequence fidelity criterion for each subsequence of a second plurality of subsequences of the target vector used during encoding; and decoding, by the decoder, the second plurality of encoded subsequences from the bitstream based on each of the subsequence fidelity criterions that define a parsing and syntax of the bitstream.

31. The method defined in claim 30 further comprising reordering the second plurality of subsequences based on order information received from the bitstream.

32. The method defined in claim 30 wherein each of the subsequence fidelity criteria comprise a bit allocation, wherein decoding of the second plurality of encoded subsequences is based on the bit allocation, and wherein the bit allocation tries not to differentiate between subsequences within the same group.

33. The method defined in claim 30 wherein generating the subsequence fidelity criteria comprises modifying a global fidelity criteria that applies only globally to encoding the target vector.

34. The method defined in claim 30 wherein the arranging of the first plurality of subsequences into groups is based on one or more types of statistical variation between the groups.

35. The method defined in claim 30 further comprising creating an unequal bit assignment across the second plurality of encoded subsequences as a function of the groups into which the first plurality of subsequences are arranged, and wherein decoding the second plurality of encoded subsequences is based on the unequal bit assignment.

36. The method defined in claim 30 wherein creating the subsequence fidelity criteria comprises generating patterns of bit assignments within each group of subsequences.

37. The method defined in claim 36 wherein creating the subsequence fidelity criteria comprises:

determining groups of bit assignments for subsequences in the same group; and reordering the bit assignments in a fixed fashion that is not driven by the partial ordering and assumes no priority of subsequences within the group specified by the partial ordering.

38. The method defined in claim 37 wherein reordering the bit assignments is based on achieving a desired perceptual effect that is not implicit on the partial ordering.

39. The method defined in claim 38 wherein the desired perceptual effect is a perceptual masking property.

40. The method defined in claim 38 wherein reordering the bit assignments comprises clustering one or more non-zero or higher bit assignments away from an already decoded area.

41. The method defined in claim 37 wherein reordering the bit assignments causes subsequences with a maximum bit allocation to be quantized before subsequences with less than the maximum bit allocation.

42. The method defined in claim 36 further comprising generating a random sequence at prescribed energy for subsequences with no information in bits describing the quantization, the random sequence being combined with the decoded subsequences to create a decoded version of a target vector.

43. The method defined in claim 30 wherein creating the subsequence fidelity criteria comprises modifying the fidelity criteria to take advantage of perceptual masking effects.

44. The method defined in claim 43 wherein the perceptual masking effects are in one or more of a group consisting of time and frequency.

45. The method defined in claim 43 further comprising adapting the noise-fill to match an exact non-zero bit assignment pattern in the criteria.

46. An article of manufacture comprising one or more computer readable media storing instructions which, when executed by a system, causes the system to perform a method comprising:

decoding encoded group membership information from a received bitstream, the group membership information being a number of bits in the bitstream that were explicitly encoded to define an ordering of groups into which a first plurality of subsequences of a target vector were arranged in accordance with a measure of the target vector available only to an encoder and not available to a decoder, wherein the ordering is a partial ordering because membership in a group represents a variation of behavior of subsequences of the first plurality of subsequences, wherein an order of the groups does not provide information on element by element values of the target vector itself, wherein the first plurality of subsequences are unequally assigned across the plurality of groups, wherein the group membership information defines only the subsequences in each group and the order of the groups, and wherein the ordering is fully recoverable using the group membership information, and wherein the one or more subsequences in each group are given equal priority within the group;

generating, based at least in part on the decoded group membership information, a subsequence fidelity criterion for each subsequence of a second plurality of subsequences of the target vector used during encoding; and decoding the second plurality of encoded subsequences from the bitstream based on each of the subsequence fidelity criterions that define a parsing and syntax of the bitstream.

* * * * *